US009604082B2

(12) United States Patent
Henyan

(10) Patent No.: US 9,604,082 B2
(45) Date of Patent: Mar. 28, 2017

(54) FORE-GRIP HANDLED FIRE-EXTINGUISHER

(71) Applicant: Nathan D. Henyan, Yakima, WA (US)

(72) Inventor: Nathan D. Henyan, Yakima, WA (US)

(73) Assignee: MPACT MPOWER, LLC., Yakima, WA (US)

( * ) Notice: Subject to any disclaimer, the term of this patent is extended or adjusted under 35 U.S.C. 154(b) by 98 days.

(21) Appl. No.: 14/575,497

(22) Filed: Dec. 18, 2014

(65) Prior Publication Data

US 2016/0175629 A1 Jun. 23, 2016

(51) Int. Cl.

| | |
|---|---|
| ***A62C 13/76*** | (2006.01) |
| ***A62C 13/78*** | (2006.01) |
| ***A62C 13/64*** | (2006.01) |
| ***A62C 17/00*** | (2006.01) |

(52) U.S. Cl.
CPC ..... *A62C 13/78* (2013.01); *A62C 17/00* (2013.01)

(58) Field of Classification Search
CPC ..... A62C 13/76; A62C 13/78; A62C 13/64; A62C 17/08; F17C 2205/0165; B65D 5/46024; B65D 83/202
USPC ..... 169/30, 51, 70–89
See application file for complete search history.

(56) References Cited

U.S. PATENT DOCUMENTS 1,538,968 A * 5/1925 Burke, Jr. ..... A62C 17/00 222/389
1,727,213 A 9/1929 McMullen
1,988,637 A * 1/1935 Tinkham ..... A62C 17/00 169/53
2,409,647 A * 10/1946 Stroop ..... A62C 13/76 169/89
2,017,319 A 3/1973 McMullen
3,782,598 A * 1/1974 Basa ..... B05C 17/0136 222/326
4,505,448 A 3/1985 Massie
4,560,193 A * 12/1985 Beebe ..... F17C 13/084 294/103.1
4,842,158 A * 6/1989 Reyes, Jr. ..... B65D 23/106 215/392
4,899,826 A * 2/1990 Penn ..... A62C 3/07 141/38
4,972,910 A * 11/1990 Fujiki ..... A62C 35/10 169/60
5,161,293 A 11/1992 Ebbert
(Continued)

OTHER PUBLICATIONS

Buckeye Fire Equipment, Product Catalog, 2013, Part No. 133250A, Kings Mountain, North Carolina.
(Continued)

*Primary Examiner* — Joseph A Greenlund
(74) *Attorney, Agent, or Firm* — Svendsen Legal, LLC.

(57) ABSTRACT

A fore-grip specially suited and configured to mount upon a tank-style fire-extinguisher for use as a defensive tool, the fore-grip including a handle that mounts near the base or bottom-end of the extinguisher tank. A tank bracket is attached to the tank of the fire extinguisher with the fore-grip mounted to the bracket, which can include a clip for the extinguisher nozzle. A user is able to concurrently grasp the handle of the fore-grip to lift and to lift and aim the fire-extinguisher, while opening the manual valve to discharge the pressurized propellant from the nozzle.

14 Claims, 5 Drawing Sheets

(56) References Cited

U.S. PATENT DOCUMENTS 5,184,684 A * 2/1993 Kohlman ..... A62C 13/78 169/51
5,549,339 A 8/1996 Frean
5,730,479 A * 3/1998 Jansson ..... F17C 13/084 294/15
5,740,968 A 4/1998 Mueller
6,527,058 B1 * 3/2003 Nerat ..... A62C 31/02 169/30
6,810,964 B1 * 11/2004 Arnot ..... A62C 13/22 169/26
7,128,163 B1 * 10/2006 Rousseau ..... A62C 13/003 169/30
7,143,833 B2 12/2006 Gaidano et al.
7,188,679 B2 * 3/2007 McSheffrey ..... A61N 1/39 169/23
7,287,735 B2 * 10/2007 Heerdt ..... A62C 13/78 169/51
7,628,217 B2 * 12/2009 Crippen ..... A62C 13/78 169/51
7,891,435 B2 * 2/2011 McSheffrey ..... A61N 1/39 116/67 R
8,844,644 B2 9/2014 Guo et al.
9,056,661 B2 * 6/2015 Macri ..... B63C 9/22
2005/0000702 A1 * 1/2005 Shim ..... A62C 13/76 169/51
2005/0039930 A1 * 2/2005 Gwak ..... A62C 13/76 169/30
2005/0211447 A1 * 9/2005 McMahon ..... A62C 11/00 169/51
2008/0245832 A1 * 10/2008 Willman ..... A62C 13/78 224/257
2009/0193702 A1 * 8/2009 Lin ..... F41C 23/16 42/72
2010/0059237 A1 * 3/2010 Cordani ..... B64D 25/00 169/54
2013/0213675 A1 * 8/2013 Rousseau ..... B05B 7/00 169/71
2015/0075054 A1 * 3/2015 Barger ..... F41G 11/003 42/90

OTHER PUBLICATIONS

Angus Fire, Portable Fire Extinguishers, Aug. 2009, Ref No. 5284/2, Oxfordshire, England (UK).
Angus Fire, 2kg Carbon Dioxide Alloy Stored Pressure, May 2001, Data Sheet No. 5318, Oxfordshire, England (UK).
Angus Fire, 2kg Carbon Dioxide Steel Stored Pressure, Aug. 2005, Data Sheet No. 5317, Oxfordshire, England (UK).

* cited by examiner

FORE-GRIP HANDLED FIRE-EXTINGUISHER

TECHNICAL FIELD

This invention pertains to a fire-extinguisher with a fore-grip, and specifically to a fore-grip specially suited and configured to mount upon a tank-style fire-extinguisher, so that a user can lift and direct the tank of the fire-extinguisher with the fore-grip, to point and direct the spray or flow from the fire-extinguisher's nozzle, as the fire-extinguisher is discharged.

BACKGROUND OF THE INVENTION

Violent intruder incidents are on the rise. These alarming incidents have occurred at public and private companies and organizations, and intuitions, such as schools and government premises. In reacting to this problem there is a rush to provide a safer school and institutional environments in the public and private sectors. A dilemma is encountered when the deterrents introduced into these environments in the name of safety, can ultimately lead to unnecessary risk and injury to the occupants we are trying to protect.

For example, certain school districts across the United States are arming teachers and administrators with handguns, in an effort to combat potentially violent intruders. However, this solution introduces firearms into the everyday school environment at an increased risk to the students and faculty. An alternative solution is needed that provides a safe, practical, and effective tool in deterring and defending against violent intruders.

The present invention addresses these problems and provides the needed safe, practical, and effective tool in deterring potentially violent intruders, and the following is a disclosure of the present invention that will be understood by reference to the following detailed description taken in conjunction with the accompanying drawings.

Figure 1:
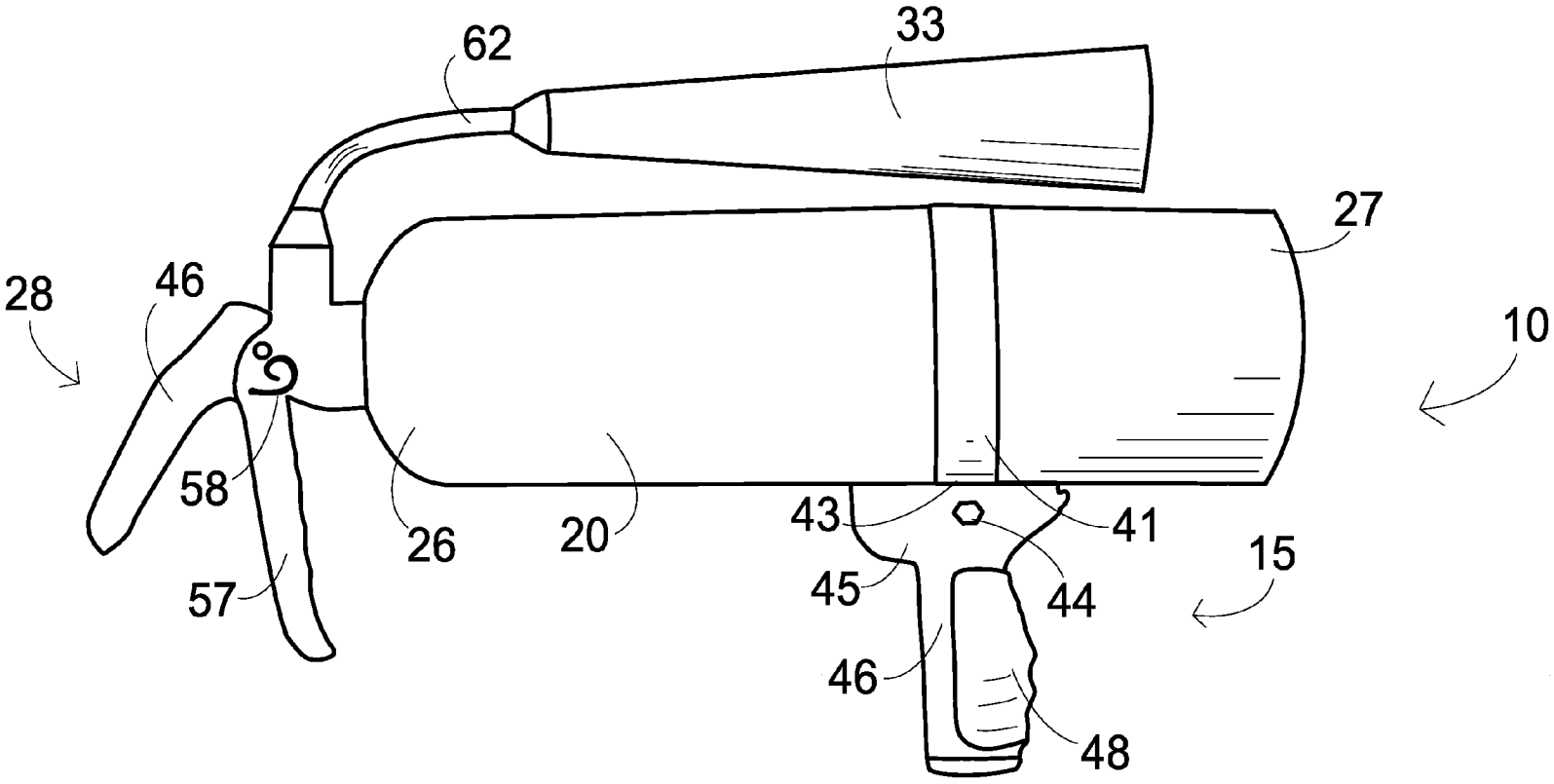
FIG. 1 is a side view of a fore-grip handled fire-extinguisher, according to an embodiment of the invention.

Reference characters included in the above drawings indicate corresponding parts throughout the several views, as discussed herein. The description herein illustrates one preferred embodiment of the invention, in one form, and the description herein is not to be construed as limiting the scope of the invention in any manner. It should be understood that the above listed figures are not necessarily to scale and may include fragmentary views, graphic symbols, diagrammatic or schematic representations, and phantom lines. Details that are not necessary for an understanding of the present invention by one skilled in the technology of the invention, or render other details difficult to perceive, may have been omitted.

DETAILED DESCRIPTION OF SPECIFIC EMBODIMENTS

The present invention is an apparatus that provides a safe, practical, and effective tool in deterring a potentially violent intruder, attacker or aggressor, with little to no danger of significant collateral damage or injury to bystanders.

If neither running nor hiding from the aggressor is a safe option, a suggested last resort when confronted, especially if the aggressor has a weapon, is that unarmed persons or bystanders in immediate danger must consider trying to block, disrupt or incapacitate the aggressor. By responding to the attacker with aggressive force, the attacker may be stopped or at least hindered. Items in the immediate environment can be considered for use as deterrents, such as fire extinguishers, tables and chairs.

The apparatus of the present invention includes a simple, cost-effective improvement to a conventional fire extinguisher, which is an implement already installed in every school and public building. It is well known that the conventional, five-pound capacity, dry-powder type of fire-extinguisher can typically shoot a high-speed discharge stream of propellant. If this propellent could be directable toward an aggressor, the propellent stream would likely impede the actions of the aggressor, covering them with a thick powder or spray over an area many times larger than the conventional, chemical spray types of repellents.

Figure 2:
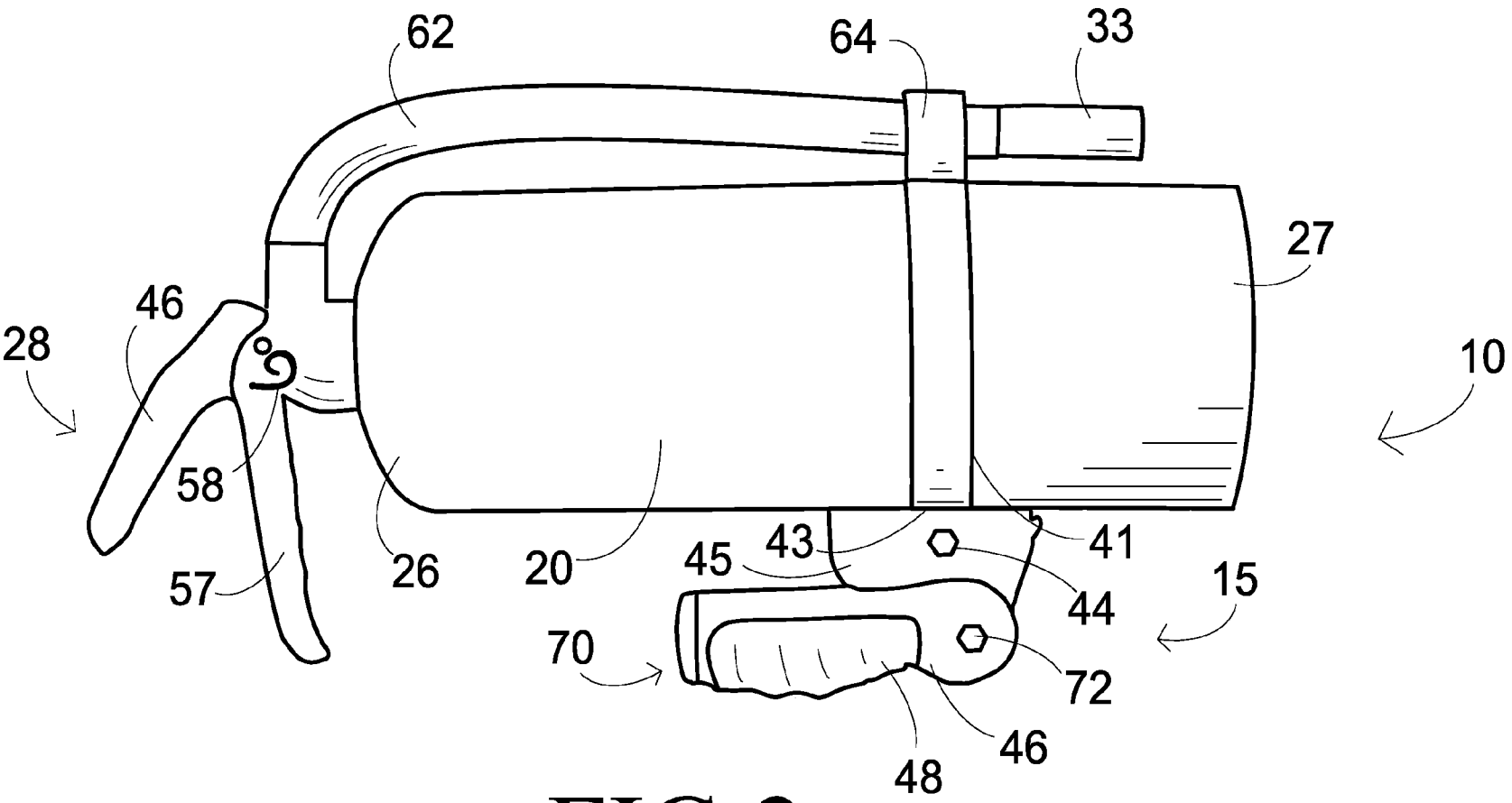
FIG. 2 is a side view of a fore-grip handled fire-extinguisher, according to an embodiment of the invention.

The present invention includes a fore-grip handled fire-extinguisher, for use as a deterrent or defense against the actions of an aggressor. FIGS. 1 through 5 show preferred embodiments of the fore-grip handled fire-extinguisher apparatus 10, which can be referred to simply herein as a "fore-grip handled fire-extinguisher." FIGS. 1 and 2 show a side view of the fore-grip handled fire-extinguisher with a fore-grip 15 mounted to a typical fire-extinguisher 17.

The typical fire extinguisher may be referred to herein as a "fire-extinguisher" or simply as an "extinguisher," and can be any conventional type of hand-holdable fire-extinguisher. Hand-held fire-extinguishers are categorized by the USCG (United States Coast Guard) as either "Size I" or "Size II," which are technically regarded as 'hand portable.' These hand-portable extinguishers are typically wall-mounted or stored in a wall mounted enclosures, and may include the ability to extinguish Class 'A', 'B' or 'C' types of fires, with dry or wet propellants, and may contain Halotron®, carbon dioxide, water, or any other conventional fire suppressing propellant.

Figure 3:
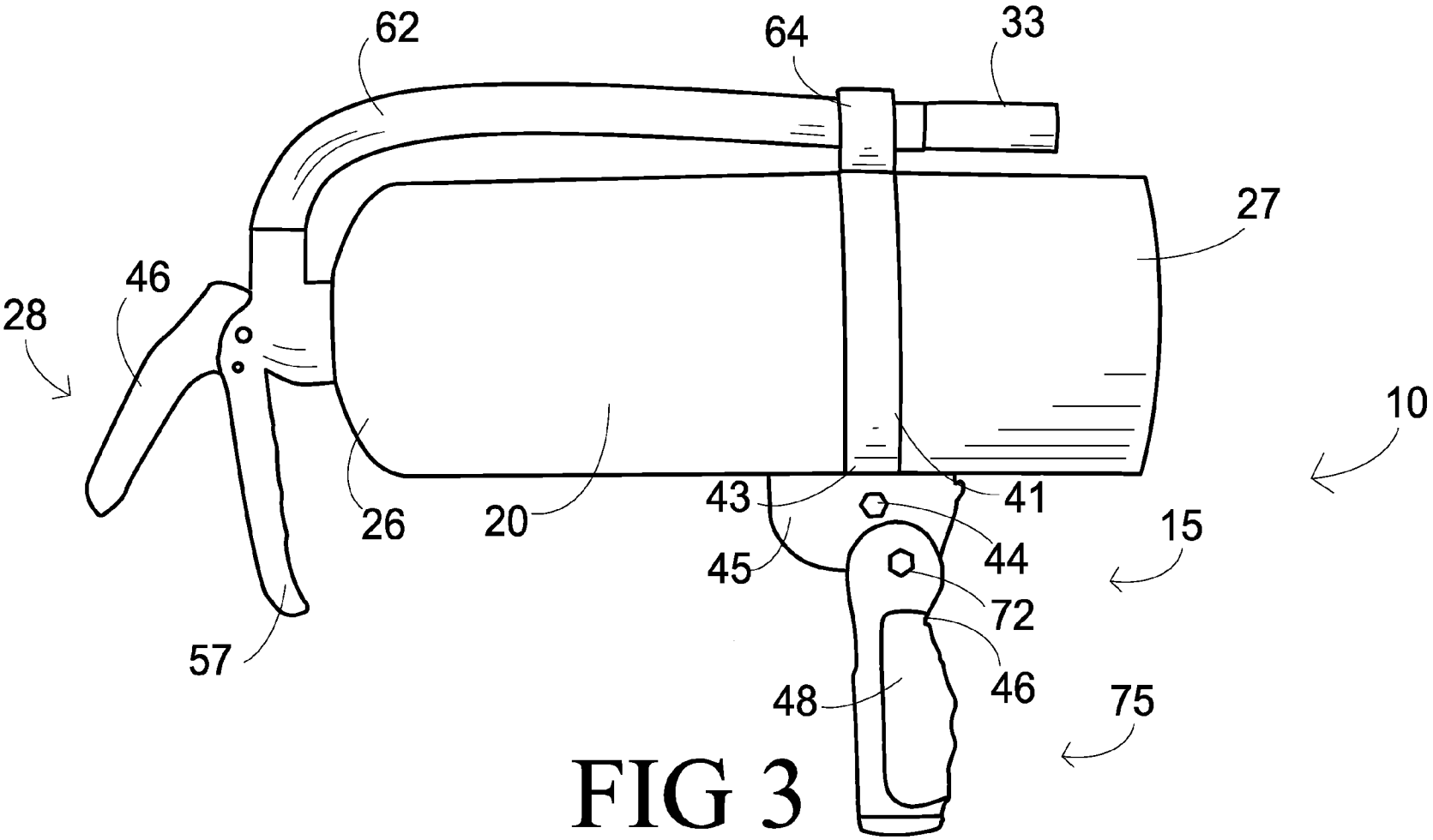
FIG. 3 is side view of a fore-grip handled fire-extinguisher, according to an embodiment of the invention.
Figure 4:
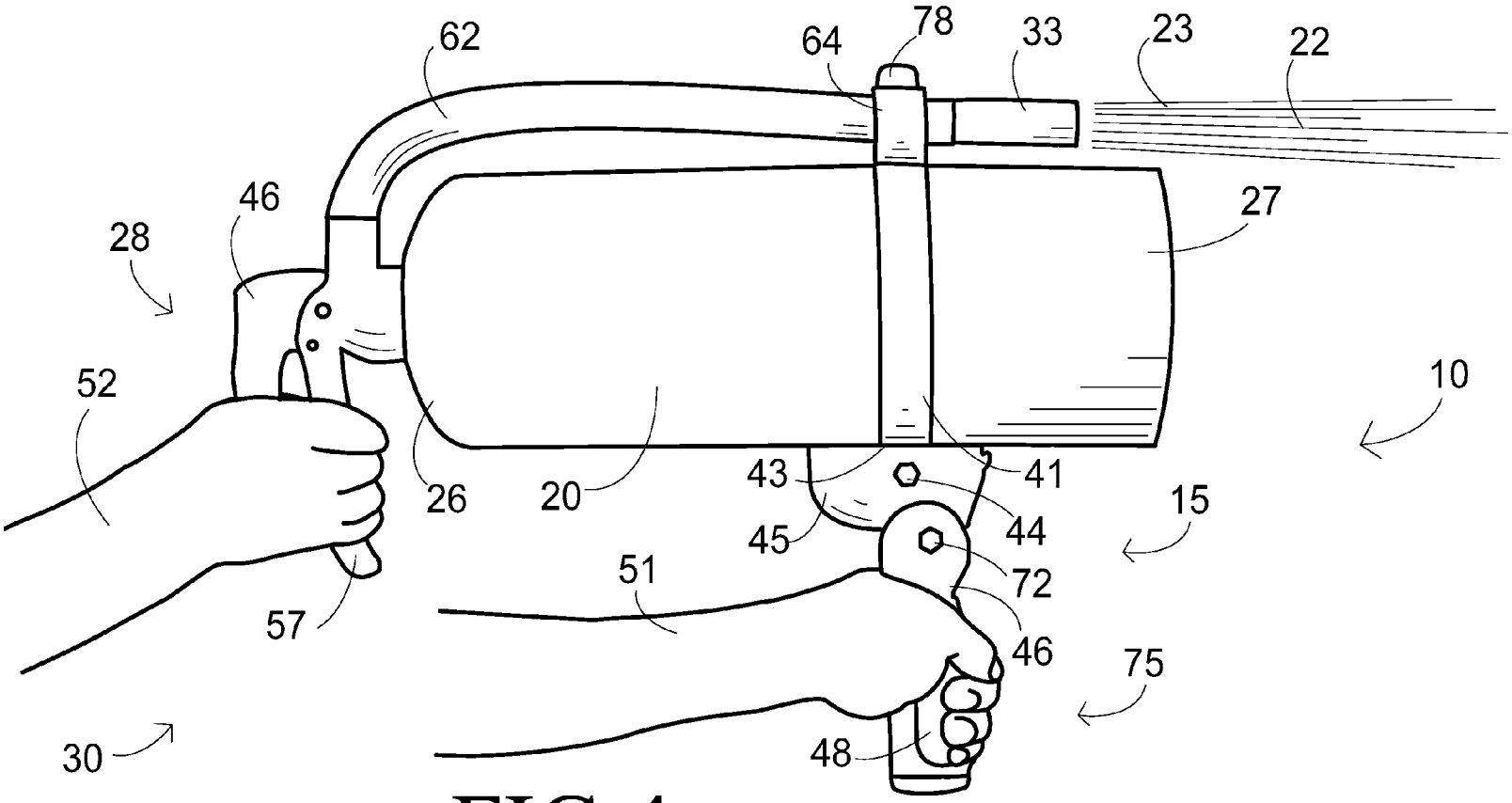
FIG. 4 is a side view of a fore-grip handled fire-extinguisher being held by a user, according to an embodiment of the invention.

The fire-extinguisher 17 includes a tank 20, as shown in FIGS. 1 through 5, and the tank contains a pressurized propellant 22, which is shown in FIG. 3 in an extinguisher discharge 23. The tank has a top end 26 opposite a bottom end 27, with a manual valve 28 located proximate the top end of the tank. Typically the bottom end of the tank is substantially flat, so that the tank can rest on a surface, such as a counter, floor, or table top. When the manual valve is depressed by a user 30, as also shown in FIG. 4, the pressurized propellent is released from the tank.

After exiting from the manual valve 28, the pressurized propellant 22 from the tank 20 is routed to a nozzle 33, as shown in FIG. 4. The pressurized propellant exits the nozzle with a high force as the extinguisher discharge 23, and is conventionally directed toward a fire. However, in the fore-grip handled fire-extinguisher 10 of the present invention, a fore-grip 15 is mounted to the tank of the fire extinguisher 17. Preferably, the fore-grip is located, proximate to the bottom end of the tank, as shown in FIGS. 1 through 4.

As shown in FIGS. 1 through 4, the fore-grip 15 preferably mounts to a tank bracket 41 attached to the tank 20 of the fire extinguisher. For this preferred embodiment of the fore-grip handled fire-extinguisher 10, the tank bracket is a metal band that encircles the tank and includes a handle receiver 43, with the fore-grip mounted on the tank at the handle receiver of the tank bracket. For the tank bracket, metal band types of attachments are well known and often used to clamp onto cylindrical objects. A stainless steel band is preferred, with a bracket bolt 44 to hold the tank bracket in place.

Most preferably, the fore-grip 15 also includes a handle mount 45, with the handle mount attachable to the handle receiver of the tank bracket 41, against the tank 20. The handle mount is preferably a high impact plastic, but could be made from a metal, such as aluminum, or any material typically used for durable handles or grips. The bracket bolt can be incorporated in the handle mount, as shown in FIGS. 1 through 4. Alternatively, a clip or a screw clamp could be used for tightening and securing the tank bracket onto the tank.

The fore-grip 15 includes a handle 46, with the handle of the fore-grip is graspable by the user 30 of the fire-extinguisher. Specifically, the handle includes a grip 48, and the user is able to concurrently grasp the grip of the handle to lift and to aim the fire-extinguisher, and open the manual valve 28 to discharge the pressurized propellant 22 from the nozzle 33. The grip may include a soft plastic insert, to aid the user in grasping the handle of the fore-grip.

As is common for fire-extinguishers, the manual valve 28 of the extinguisher 17 includes a valve handle 56 and a valve trigger 57. Typically, after pulling a safety-pin 58 to allow movement of the valve trigger, the valve trigger is depressed toward the valve handle to open the manual valve and release the pressurized propellent from the tank. The user has a first hand 51 and a second hand 52. The user can hold the handle of the fore-grip with their first hand, while holding the manual valve of the extinguisher with their second hand.

The nozzle 33 connected to the manual valve 28 serves to direct the pressurized propellent 22 as the pressurized propellent discharges from the fire-extinguisher when the manual valve is opened. Typically, a hose 62 connects the manual valve to the nozzle, which allows the user to grasp the nozzle and direct the direction of the extinguisher discharge. However, for the present invention it is most preferred to attach the nozzle or alternatively the hose to the fire extinguisher, as shown in FIGS. 2 through 5, to direct the extinguisher discharge toward the bottom end of the tank, as shown in FIG. 4.

After grasping the manual valve 28 and the fore-grip 15, and the user 30 may lift the extinguisher 17 and direct the bottom end 27 or base of the tank 20 with the handle grip. With the aid of the fore-grip, the user can point and direct the spray of the pressurized propellent as extinguisher discharge from the nozzle, as the valve trigger 57 is gripped and depressed, as shown in FIG. 4.

Most preferably, the tank bracket 41 includes a clip 64 positioned opposite from the handle receiver 43, when the tank bracket is attached to the tank 20. The nozzle 33 is receivable into the clip, or alternatively the hose 62 is receivable into the clip, as shown in FIGS. 2 through 5, as most preferred. With the hose inserted into the clip, the nozzle is directed toward the bottom end 27 of the tank, and when the fire extinguisher 17 is lifted as shown in FIG. 4, and the valve trigger 57 depressed. The extinguisher discharge 23 is substantially or approximately horizontal, and can be aimed as the user 30 desires. Specifically, with the nozzle supported or attached to the tank with the clip, the user can lift and direct the tank of the fire-extinguisher with the fore-grip 15, to point and direct the spray or flow of pressurized propellant 22 as exhaust discharge from the fire-extinguisher's nozzle.

In a preferred option of the fore-grip handled fire-extinguisher 10 of the present invention, instead of being fixed in place, the fore-grip 15 can be hinged, and retractable to a stowed position 70. As shown in FIG. 2 compared to FIG. 3, the handle 46 of the fore-grip can hingably rotate about a handle pivot 72, the handle movable about the handle pivot from the stowed position to a deployed position 75. The handle may be made of any appropriate material, including plastic or metal. A preferred handle is a black-anodized aluminum handle with a checked style grip, as conventionally manufactured for use with rifles or automatic firearms.

The handle pivot 72 hingably joins the handle mount 45 to the handle receiver 43 of the tank bracket 41. With the fore-grip retracted to the stowed position, the fore-grip handled fire-extinguisher can be placed into most conventional enclosures or cabinets for fire-extinguishers, and is also less obtrusive when the fire extinguisher is mounted to a wall or bulkhead.

Figure 5:
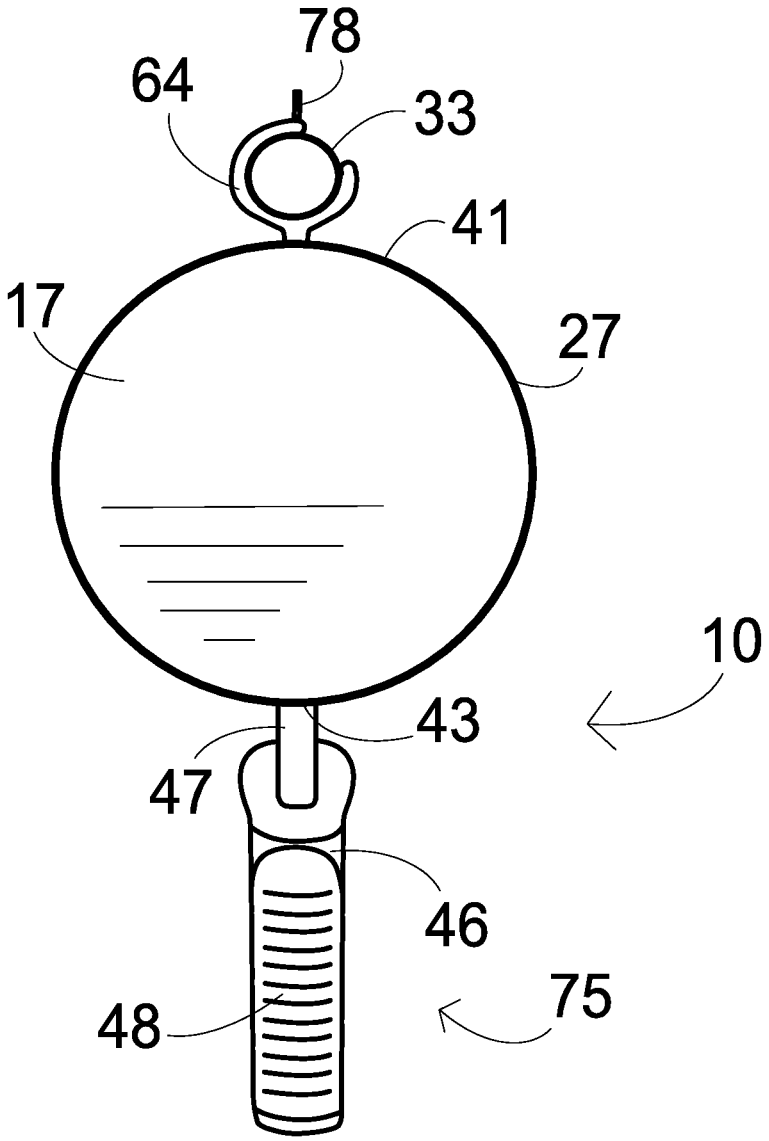
FIG. 5 is an end view of a fore-grip handled fire-extinguisher, according to an embodiment of the invention.

In an additional optional feature of the fore-grip handled fire-extinguisher 10, the clip 64 of the tank bracket 41 can include a sight 78, the sight for aiding in the aiming of the fire-extinguisher 17 by the user 30. The sight may be a simple rib extending out from the clip, as shown in FIGS. 4 and 5, or be a conventional 'flip-up' type of sight attached to the clip. The flip-up style of sight is well known by persons skilled in the design of aiming sight.

A benefit of the fore-grip handled fire-extinguisher 10 of the present invention is that there is a minimum, if any collateral injuries to bystanders, being that most pressurized propellents 22 employed on fire extinguishers 17 are chemically benign, or of low toxic hazzard other than asphyxiation, but only if inhalation is prolonged. As compared to mace or pepper sprays, the fire-extinguisher as modified to the fore-grip handled fire-extinguisher offers a much safer alternative to these irritative and potentially lethal deterrents. Furthermore, chemical irritants and repellants, such as pepper spray is well known to cause allergic reactions for many individuals, which can be severe. These reactions are not desirable for bystanders and defenders using the sprays. Additionally, it has been proposed that powerful insect sprays be used for the purpose of repelling attackers. The toxic insecticide ingredients in wasp sprays are certainly harmful to humans, and residual effects of these sprays can be long-lasting and difficult to remediate or remove. With most of the these known defensive sprays, permanent damage to the interior of the building can result, especially after the spray has absorbed into porous materials, such as carpets, drapes and furniture fabrics. Often, after the discharge of such sprays, the building's interior must be professionally cleaned and often gutted, with all fabric and porous materials replaced, usually at a high expense.

A desired effect of the extinguisher discharge 23 is to halt and incapacitate an attacker. The attacker will invariably try to clean their face and clear breathing after the mass of powder or other pressurized propellant 22 is sprayed to their face. Certainly, the attacker will be startled by the directional discharge of the fore-grip handled fire-extinguisher 10, and additionally the diversion should give the attacker pause, providing the user 33 and other defenders the time and opportunity to subdue the attacker or simply flee.

It is an important additional benefit of the fore-grip handled fire-extinguisher 10 that the user 33 does not need to be a marksman or good shot to use the fore-grip handled fire-extinguisher as compared with a standard firearm. The broad issuance and use of guns to non-police personnel in an effort to deter and defend against attackers in crowed paces, public or private is a mixed advantage. Injury and death caused by the mishandling and inadvertent discharge of the firearm may outweigh its deterrent value, in that it is arguable that more persons are injured by these inadvertent and accidental gun discharges that are saved as a result of their intended deterrent benefit against intruders or attackers. Additionally, even in a situation that the firearm is truly needed, the undertrained person with the firearm is often untrained to handle the stress and near reflexive response required to repel an aggressive attacker. Gun fire misses cannot only hit innocents and bystanders, but also travel through walls and doors, only adding to the toll and damage to life and property.

Instead, the fore-grip handled fire-extinguisher 10 appears to be the ambiguous and unassuming fire-extinguisher 17, a safety apparatus designed solely for putting out a fire. The improvement of the present invention transforms the conventional portable fire-extinguisher into a multipurpose instrument that will allow the user 33 not only to control fires, but break out windows for evacuation, and in life threatening situations attempt to subdue an attacker or aggressor to ultimately overcome the threat, and saving bystanders from harm. With the fore-grip 15, the fire-extinguisher becomes an 'impact device' that can be used with controlled force and precision against obstacles as well as aggressors.

Again, the ease of use for the fore-grip handled fire-extinguisher 10 of the present invention is of critical importance. Under stress, the ability to perform and precise actions or involving "fine motor skills" are greatly diminished, such as placing a key in a lock. The use of the fore-grip handled fire-extinguisher requires only "gross motor skills" such as the precision required to push open a door. The effective use of the fore-grip handled fire-extinguisher only requires a minim of training and can be used by almost any user 33.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

Of note, the terms "substantially," "proximate to" and "approximately" are employed herein throughout, including this detailed description and the attached claims, with the understanding that is denotes a level of exactitude or equivalence in amount or location commensurate with the skill and precision typical for the particular field of endeavor, as applicable.

The following is claimed:

1. A fore-griped fire-extinguisher apparatus comprising:

a fire-extinguisher having a manual valve and a tank, the tank containing a pressurized propellant, and the manual valve for releasing the pressurized propellent from the tank;

the tank having a top end opposite a bottom end, and the manual valve located proximate to the top end of the tank;

a nozzle connected to the manual valve, the nozzle for directing the pressurized propellent as the pressurized propellent discharges from the fire-extinguisher when the manual valve is opened; and a fore-grip mounted to the tank of the fire-extinguisher, the fore-grip located on the tank proximate to the bottom end of the tank.

2. The fore-griped fire-extinguisher apparatus of claim 1, wherein:

the fore-grip includes a handle, and the handle of the fore-grip graspable by a user of the fire-extinguisher.

3. The fore-griped fire-extinguisher apparatus of claim 2, wherein:

the user is able to concurrently grasp the handle of the fore-grip to lift and to aim the fire-extinguisher, and open the manual valve to discharge the pressurized propellant from the nozzle.

4. The fore-griped fire-extinguisher apparatus of claim 1, wherein:

the fore-grip includes a handle pivot and a handle, the handle pivotable about the handle pivot and from a retracted position to a deployed position.

5. The fore-griped fire-extinguisher apparatus of claim 1, additionally including:

a tank bracket attached to the tank of the fire extinguisher, the tank bracket including a handle receiver, and the fore-grip mounted to the tank at the handle receiver of the tank bracket.

6. The fore-griped fire-extinguisher apparatus of claim 1, wherein:

the tank bracket includes a clip, with the nozzle receivable into the clip.

7. The fore-griped fire-extinguisher apparatus of claim 6, wherein:

the clip includes a sight, the sight for aiding in the aiming of the fire-extinguisher by a user.

8. The fore-griped fire-extinguisher apparatus of claim 1, additionally including:

a hose connecting manual valve to the nozzle, the hose for routing the pressurized propellent discharged from the tank of the fire-extinguisher when the manual valve is opened.

9. The fore-griped fire-extinguisher apparatus of claim 8, wherein:

the tank bracket includes a clip, with the hose receivable into the clip.

10. The fore-griped fire-extinguisher apparatus of claim 8, wherein:

the fire extinguisher is hand portable.

11. A fore-griped handled fire-extinguisher apparatus comprising:

a fire-extinguisher having a manual valve and a tank, the tank containing a pressurized propellant, and the manual valve for releasing the pressurized propellent from the tank;

the tank having a top end opposite a bottom end, and the manual valve located proximate to the top end of the tank;

a nozzle connected to the manual valve, the nozzle for directing the pressurized propellent as the pressurized propellent discharges from the fire-extinguisher when the manual valve is opened;

a tank bracket attached to the tank of the fire extinguisher, the tank bracket including a handle receiver, and a fore-grip mounted to the tank at the handle receiver of the tank bracket, the fore-grip located on the tank proximate the bottom end of the tank; and the user is able to concurrently grasp the fore-grip to lift and to aim the fire-extinguisher, and open the manual valve to discharge the pressurized propellant from the nozzle.

12. The fore-griped handled fire-extinguisher apparatus of claim 11, wherein:

the tank bracket includes a clip, with the nozzle receivable into the clip.

13. The fore-griped fire-extinguisher apparatus of claim 11, wherein:

the fore-grip includes a handle pivot and a handle, the handle pivotable about the handle pivot and from a retracted position to a deployed position.

14. A fore-griped handled fire-extinguisher apparatus comprising:

a fire-extinguisher having a manual valve and a tank, the tank containing a pressurized propellant, and the manual valve for releasing the pressurized propellent from the tank;

the tank having a top end opposite a bottom end, and the manual valve located proximate to the top end of the tank;

a nozzle connected to the manual valve, the nozzle for directing the pressurized propellent as the pressurized propellent discharges from the fire-extinguisher when the manual valve is opened;

a tank bracket attached to the tank of the fire extinguisher, the tank bracket including a handle receiver and a clip, a fore-grip mounted to the tank at the handle receiver of the tank bracket and the fore-grip located on the tank proximate the bottom end of the tank, and the nozzle receivable into the clip; and the user is able to concurrently grasp the fore-grip to lift and to aim the fire-extinguisher, and open the manual valve to discharge the pressurized propellant from the nozzle.

* * * * *